US006368230B1

(12) United States Patent
Helmstetter et al.

(10) Patent No.: US 6,368,230 B1
(45) Date of Patent: Apr. 9, 2002

(54) GOLF CLUB FITTING DEVICE

(75) Inventors: Richard C. Helmstetter, Rancho Santa Fe; Andrew J. Goodjohn; Donald A. Bistline, both of Vista; James C. Wenck, Carlsbad, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/685,731

(22) Filed: Oct. 11, 2000

(51) Int. Cl.[7] ..... A63B 69/36; A63B 53/02

(52) U.S. Cl. ..... 473/244; 473/316; 473/345; 473/349; 473/247; 473/314; 473/305

(58) Field of Search ..... 473/244, 245, 473/246, 247, 248, 305, 306, 307, 308, 309, 310, 311, 312, 313, 314, 315, 316, 325, 288, 345, 349; 73/65.03

(56) References Cited

U.S. PATENT DOCUMENTS 1,167,922 A * 1/1916 Offutt
2,067,556 A * 1/1937 Wettlaufer
2,214,079 A 9/1940 Horton
2,219,670 A * 10/1940 Wettlaufer
3,810,621 A * 5/1974 Mills
4,181,165 A * 1/1980 Ramsay
4,455,022 A * 6/1984 Wright
4,948,132 A * 8/1990 Wharton
5,197,733 A * 3/1993 Schroder
5,511,779 A * 4/1996 Meyers
5,513,844 A 5/1996 Ashcraft et al.
5,575,723 A * 11/1996 Take
5,626,528 A * 5/1997 Toulon
5,688,188 A * 11/1997 Chappell
5,722,901 A 3/1998 Barron et al.
5,766,089 A * 6/1998 Dekura
5,839,973 A * 11/1998 Jackson
5,851,155 A * 12/1998 Wood
5,888,149 A * 3/1999 Allen
5,906,549 A * 5/1999 Kubica
5,951,411 A 9/1999 Wood et al.

* cited by examiner

*Primary Examiner*—Sebastiano Passaniti
(74) *Attorney, Agent, or Firm*—Michael A. Catania

(57) ABSTRACT

A golf club fitting device (20) is disclosed herein. The fitting device (20) includes a club head (22) with an internal hosel (38) that has a bore (39) that extends from a crown opening (52) to a sole opening (62). A removable insert (51) is disposed within the internal hosel (38), and a shaft (40) is disposed within a chamber (77) of the removable insert (51). The removable insert (51) has an annular indentation (73) for engagement with a locking member (57), and a plurality of recesses (83) for engagement with a rotation detent (59). The chamber (77) is disposed at a predetermined angle within the removable insert (51) to define a face angle of the golf club fitting device (20). The removable insert (51) is capable of rotation within the bore (39) of the internal hosel (38) to adjust the face angle of the fitting device (20). Further, the removable insert (51) and shaft (40) are easily removed from the club head (22) and substituted therefor.

14 Claims, 5 Drawing Sheets

GOLF CLUB FITTING DEVICE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a device for determining the proper wood-type golf club for a particular golfer. More specifically, the present invention relates to a device for determining the proper face angle, shaft length, shaft type and other parameters for a wood-type golf club for a particular golfer.

2. Description of the Related Art

In order to improve their game, golfers seek customization of their equipment to their particular swing. Golf equipment manufacturers have responded by increasing the different types of clubs available to the average golfer. For drivers, this has included increasing the different number of lofts readily available to the average golfer. Further, the average golfer can choose the type of shaft, whether metal or graphite, appropriate to the golfer's swing. Additionally, the length of the shaft may be adjusted, and the type of grip can be customized for the golfer.

However, golfers demand perfection, and every possible adjustment must be made to fit a particular golfer's swing. Thus, drivers that allow for adjustments in the lie angle and face angle have been made available to golfers. One such driver is Jackson, U.S. Pat. No. 5,839,973 for a Golf Club Head With Enlarged Hosel, originally filed in 1996. The insert of Jackson is removable thereby allowing for another insert with a different shaft orientation to be inserted into the hosel. The insert of Jackson has a diameter that is much larger than that of the tip end of the shaft.

Another example is Schroder, U.S. Pat. No. 5,197,733, filed in 1990 for a Golf Club. The Schroder patent discloses a club head with an elongated lower shaft portion that can be rotated to adjust the face angle of the golf club. The lower shaft portion is adjustable by rotating the shaft to accommodate the golfer, however, the tip of the shaft will be disposed behind or in proximity to the center of percussion of the golf club. Additionally, Schroder requires a particular shaft, with a lower angled portion, for the golf club head.

A further example is Toulon, U.S. Pat. No. 5,626,528, filed in 1996, for a Golf Club Head And Hosel Construction. The Toulon patent discloses a hosel with a slot groove that provides for adjustment of the face angle by five degrees and the lie angle by seven degrees by application of a transverse bending force on the hosel.

A further example of such an invention is Wood, et al., U.S. Pat. No. 5,851,155, which was originally filed in 1997. The Wood patent discloses a hosel that allows for customization of the face angle for a particular golfer by reorienting the club head relative to a neck member of the hosel.

Yet a further example is Kubica, U.S. Pat. No. 5,906,549 which was filed in 1997 for a golf club and a multitude of hosels with each hosel having a passage with a different angle relative to the club head. Each hosel has a flat portion for securing the hosel within a bore in the club head. In order to adjust the angle, the hosel must be replaced with another hosel. The hosels are composed of a material softer than the club head.

The prior art also contains the use of inserts for non-adjustment purposes. One example of the prior art is Chappell, U.S. Pat. No. 5,688,188 for a golf club. The Chappell patent discloses an iron with a ferrule composed of a thermoplastic material having a modulus of elasticity of 80–1980 pounds per square inch, a specific gravity of 1.15 to 1.22, shore hardness of 60, and an Izod strength of 3.0 to 10.0 ft/lbs. The ferrule is placed within an external hosel, and the exposed end of the ferrule 21 millimeters. The preferred material is a butyrate.

Another example is Dekura, U.S. Pat. No. 5,1766,089, which was originally filed in Japan in 1994 for a metal wood composed of magnesium or aluminum alloy with a hosel attaching section composed of ABS and epoxy. The rigidity of the hosel attaching section is lower than the shaft to absorb vibration and shock to thereby reduce vibrations through the shaft.

Another example is Take et al., U.S. Pat. No. 5,575,723, originally filed in Japan in 1994 for a Golf club With Cushion Material Between Shaft And Head. The Take patent discloses the use of a cushioning member composed of a synthetic resin such as ABS resin, polycarbonate, or epoxy, in order to cushion the shaft within the metal head.

Another example is Allen, U.S. Pat. No. 5,888,149 which was originally filed in 1999 for a shortened hosel and an extended ferrule. The primary object of the Allen patent is to reduce hosel weight without sacrificing shaft support or cosmetic integrity. The Allen patent discloses a hosel with a length of 0.625 inch to 0.750 inch, and an extended ferrule composed of a high strength thermoplastic.

One of the earliest example is Offutt, U.S. Pat. No. 1,167,922, originally filed in 1914 for a golf club head with an enlargement on a tubular metal shaft to provide a fluted surface.

The furtherance of golf club customization has led to the invention of fitting devices to allow a golfer to adjust different parameters on a golf club to determine the appropriate parameters for themselves. One such invention is Ashcraft et al., U.S. Pat. No. 5,513,844 for a Golf Club Fitting Apparatus, originally filed in 1994. The Ashcraft patent discloses a golf club head that has a mechanism on the heel end for removal of a shaft and hosel. The Ashcraft mechanism involves a slit that extends to a bore in which the shaft and hosel is placed for securing to the club head. The slit allows for the expansion of the bore for removal of the shaft and hosel.

Another fitting device is Barron et al., U.S. Pat. No. 5,722,901, originally filed in 1997. The Barron patent discloses a releasable structure that has a spring mechanism for retaining the shaft to the club head.

Golfers want a high performance golf club that can be easily customized to them while golf equipment manufacturers need to provide as much standardization as possible in order to prevent escalation of manufacturing costs. Thus, although the prior art has presented many inventions for providing customization, the prior art has failed to provide a cost effective method of customization.

BRIEF SUMMARY OF THE INVENTION

The present invention provides a solution to the cost-effective customization of golf clubs while providing golfers with golf clubs that they currently play and trust to give them optimal performance. The present invention is able to accomplish this by providing a fitting device for a golf club that allows for orientation and substitution of the shaft in order to determine the appropriate parameters for a particular golfer.

One aspect of the present invention is a golf club fitting device including a golf club head and a shaft that is easily removable. The golf club head has a crown, a sole, a striking plate and an internal hosel. The internal hosel has a hosel wall defining a bore that extends from a crown opening below a top of the crown to a sole opening at the sole. The shaft is attached to a removable insert which is disposed within the internal hosel. The removable insert may be rotated within the internal hosel to change the face angle of the golf club.

The shaft and removable insert are retained within the internal hosel by a locking member that is disposed on the heel end of the body of the golf club head. A rotation detent, otherwise known as a second locking member, which prevents rotation of the removable insert when engaged, is also disposed on the heel end.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
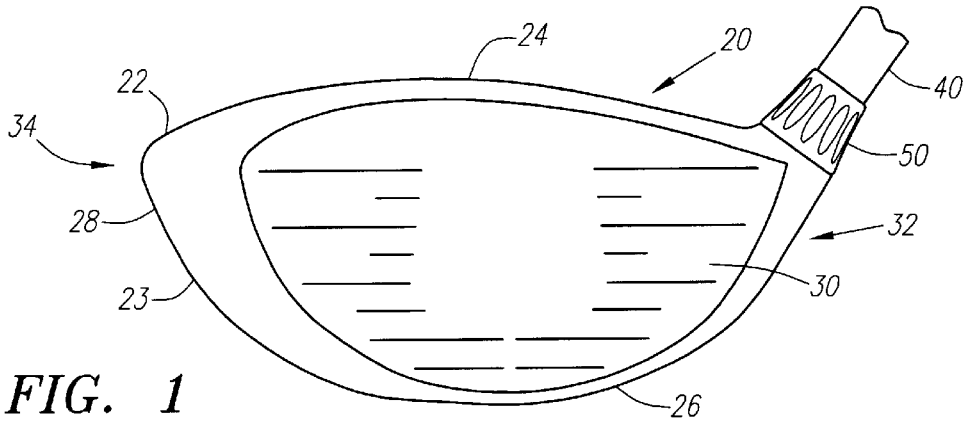
FIG. 1 is a front plan view of the golf club fitting device of the present invention.
Figure 2:
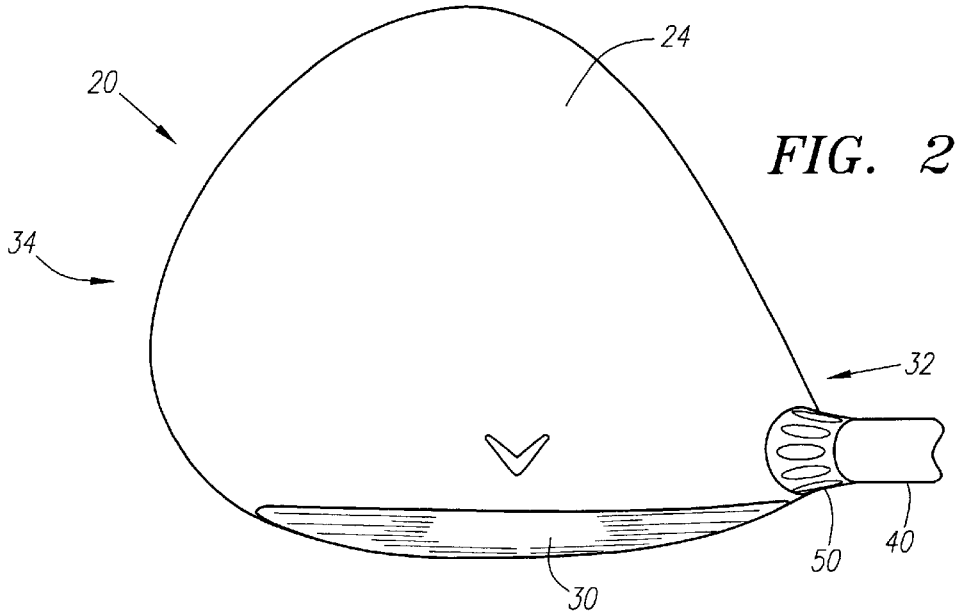
FIG. 2 is a top plan view of the golf club fitting device of FIG. 1.

As shown in FIGS. 1–4, a golf club fitting device is generally designated 20. The golf club fitting device 20 has a golf club head 22 and a shaft 40 removably connected to the golf club head 22. The golf club head 22 has a body 23 with a crown 24, a sole 26, a ribbon 28 and a striking plate 30. The striking plate 30 generally extends from a heel end 32 to a toe end 34 of the front of the golf club head 22. The body 23 preferably has a hollow interior 36 with an internal hosel 38 for receiving the tip end of a shaft 40 through a hosel liner 50 which is disposed within a removable insert 51. As will be explained in greater detail below, the removable insert 51 allows for adjustment of the face angle of the golf club 20, and removal substitution of the shaft 40, while only minimally changing the properties of the golf club fitting device 20 from that of a commercial golf club.

The golf club head 22 has a body 23 that is preferably composed of a metal material such as titanium, titanium alloy, stainless steel, or the like, and is most preferably composed of a forged titanium material. However, those skilled in the pertinent art will recognize that the body 23 may be composed of alternative materials such as composites such as a pre-peg resin with carbon strands.

The body 23, when designed as a driver, has a volume that ranges from 200 cubic centimeters to 400 cubic centimeters. To simulate the size of commercial golf clubs, a body 23 composed of stainless steel has a volume range of 200 cubic centimeters to 275 cubic centimeters, a body composed of titanium has a volume range of 275 cubic centimeters to 350 cubic centimeters, and a body 23 composed of a composite material has a volume of 325 cubic centimeters to 400 cubic centimeters. The body 23, when designed as a driver, preferably weighs no more than 215 grams, and most preferably weighs between 180 and 205 grams. When the body 23 is designed as a fairway wood, the volume ranges from 150 cubic centimeters to 275 cubic centimeters, and the body 23 weighs from 135 grams to 180 grams.

The shaft 40 is interchangeable thereby allowing a golfer to determine the length, flex, material composition, weight, and the like which are appropriate for that particular golfer. The shaft 40 is composed of a graphite, stainless steel, titanium, hickory, a hybrid of graphite and metal, or other similar material compositions. The weight of the shaft 40 ranges from 40 grams to 100 grams. The flex of the shaft is either light, regular, firm or strong. The shaft 40 is attached to the golf club head 22 through the hosel liner 50 and the removable insert 51. The removable insert 51 is positioned within the internal hosel 38 of the golf club head 22. The hosel liner 50 is positioned within removable insert 51.

Figure 7:
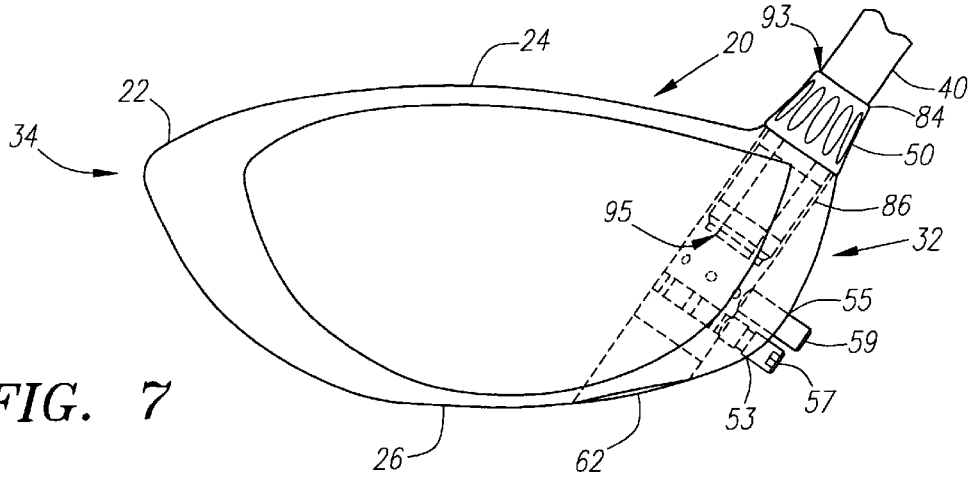
FIG. 7 is a front plan view of the golf club fitting device of FIG. 1 with the internal hosel, removable insert and hosel liner in phantom.
Figure 8:
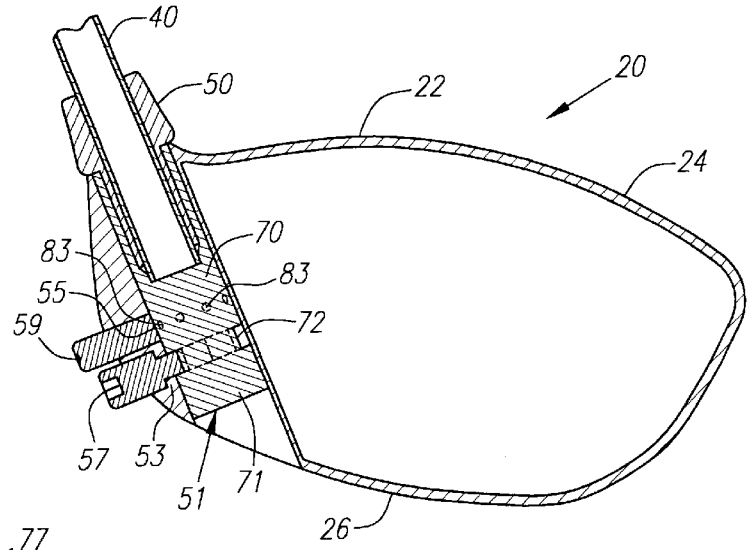
FIG. 8 is a cross-sectional view of line 8—8 of FIG. 3.
Figure 9:
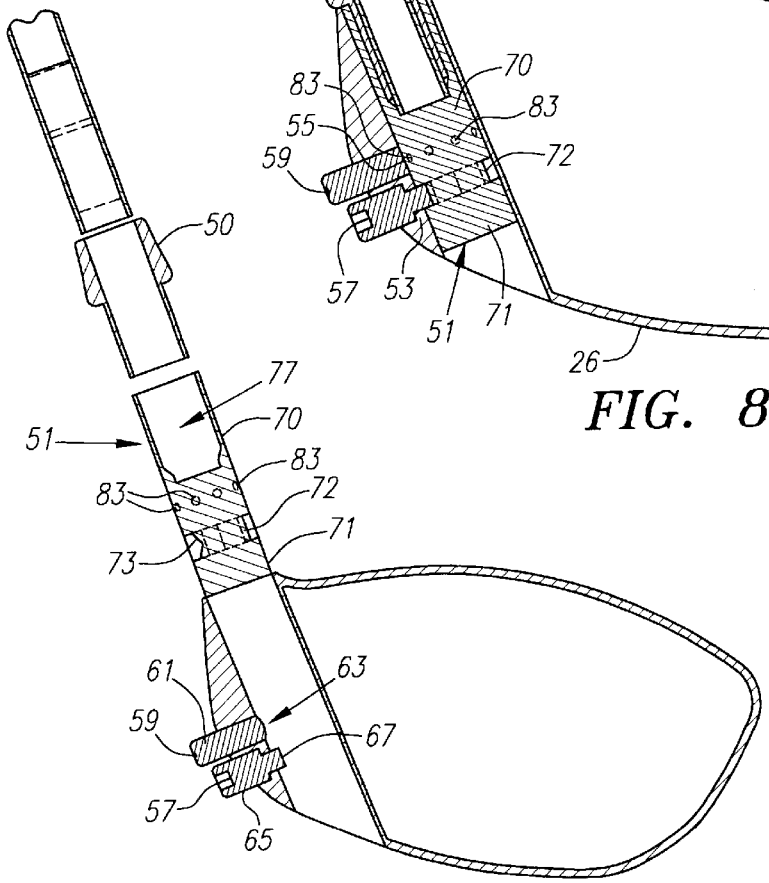
FIG. 9 is an exploded view of FIG. 8.
Figure 10:
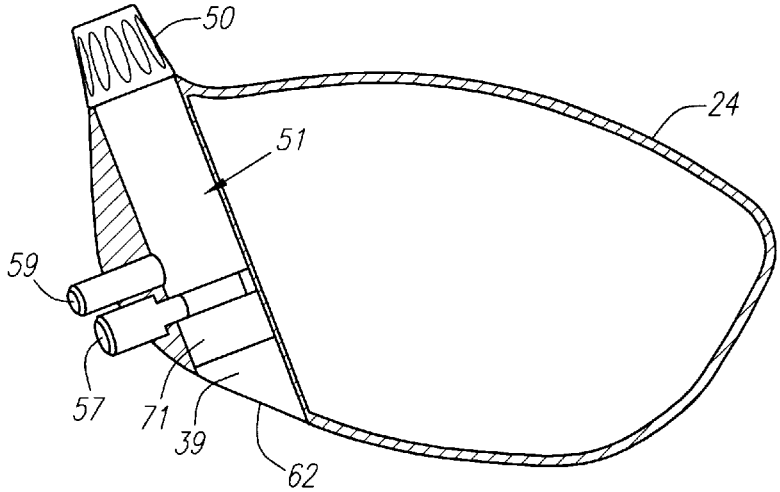
FIG. 10 is a cross-sectional view of the front of the golf club head.
Figure 11:
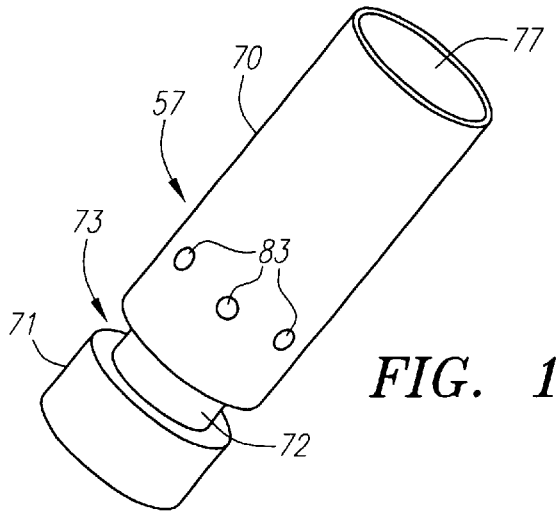
FIG. 11 is an isolated perspective view of the removable insert.
Figure 12:
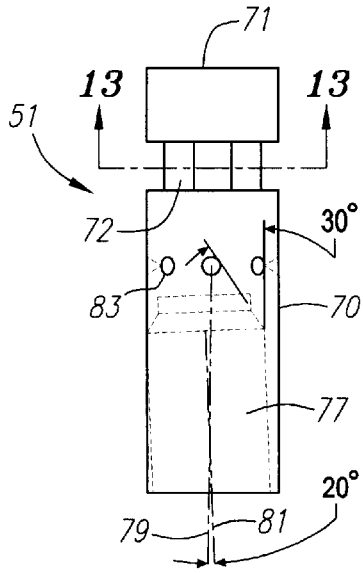
FIG. 12 is an isolated side view of the removable insert.
Figure 14:
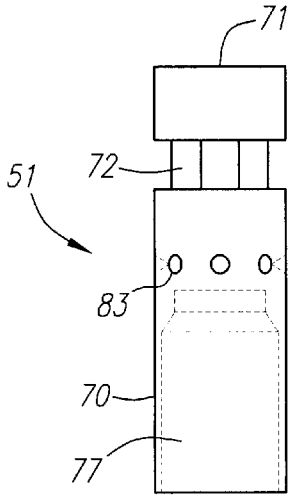
FIG. 14 is an isolated side view of an alternative removable insert with a different bore angle.
Figure 13:
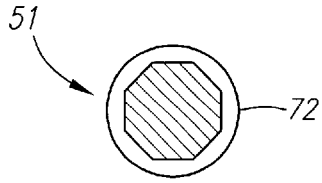
FIG. 13 is an isolated top view of the removable insert.

The internal hosel 38 does not substantially extend beyond the surface of the crown 24 of the golf club head 22. More precisely, the internal hosel 38 is lower than the top of the crown 24 when the golf club 20 is in the address position to strike a golf ball. The internal hosel 38 is positioned within the hollow interior 36 of the golf club head 22, nearest the heel end 32. As best shown in FIGS. 7–9, the internal hosel 38 includes a wall 60 that defines a bore 39 that opens at a crown opening 52 and a sole opening 62 of the body 23. The bore 39 is sized to accommodate the removable insert 51. The removable insert 51 is placed within the bore 39 of the internal hosel 38. The internal hosel 38 is preferably cast with the body 23 of the golf club head 22. Alternatively, the internal hosel 38 may be welded within the hollow interior 36 in alignment with the crown opening 52 and the sole opening 62 of the body 23. The diameter of the bore 39 is not much greater than the outer diameter of the removable insert 51 thereby allowing for a tight fit of the removable insert 51 within the bore 39.

The mechanism for removably retaining the shaft 40 to the golf club head 22 is described below. As shown in FIGS.

7–9, a first aperture 53 and a second aperture 55 are located on the heel end 32 of the body 23. The apertures 53 and 55 extend through the heel wall of the body 23, through the wall 60 of internal hosel 38 and into the bore 39. The apertures 53 and 55 are sized to receive a locking member 57 and a rotation detent 59. The rotation detent 59 has a cylindrical body 61 with a tapered end 63. The locking member has an exterior body 65 and an interior body 67. The exterior body 65 has a larger diameter than the interior body 67. The apertures 53 and 55 may be threaded to receive a threaded portion of the locking member 57 and the rotation detent 59, respectively. In this manner the removable insert 51 and shaft 40 are quickly removed from the golf club head 22 and substituted therefor.

As shown in FIGS. 7–14, the removable insert 51 has an upper portion 70, a lower portion 71 and a transition portion 72 juxtaposed by the upper portion 70 and the lower portion 71. The transition portion 72 has a diameter less than that of either the upper portion 70 or the lower portion 71 thereby forming an annular indentation 73 in the removable insert 51. The upper portion 70 has a chamber 77 for receiving the hosel liner 50. The chamber 77 terminates before the transition portion 72. The chamber 77 is angled relative to a central axis 79 of the removable insert 51 such that a central axis 81 of the chamber 77 is at an angle of between 0.0 to 3.5 degrees relative to the central axis 79 of the removable insert 51.

The internal angling of the chamber 77 relative to the central axis 79 allows for the adjustment of the face angle of the golf club fitting device 20. For example, a quarter rotation of the removable insert 51 within the internal hosel 38 will change the face angle of the golf club fitting device 20 by a predetermined amount. A half rotation will further adjust the face angle, and a three-quarters adjustment will modify the face angle even further. Additional adjustments to the face angle of the golf club fitting device 20 are accomplished by exchanging a first removable insert 51 having a first chamber angle relative to a central axis 79 with a second removable insert 51 having a second chamber angle relative to a central axis 79.

The upper portion 70 of the removable insert 51 also has a plurality of recesses 83. Each recess 83 is sized to receive the tapered end 63 of the rotation detent 59. The rotation detent 59 prevents rotation of the upper portion 70 of the removable insert 51. The rotation detent 59 is pulled outward from the second aperture 55 to allow the upper portion 70 of the removable insert 51 to be rotated to adjust the face angle.

The interior body 67 of the locking member 57 engages the annular indentation 73 of the removable insert 51 to lock the removable insert within the bore 39 of the internal hosel 38. The locking member 57 is pulled outward, or unthreaded, from the first aperture 53 in order to allow for removal and substitution of a shaft 40.

The hosel liner 50 generally includes an upper portion 84 and a lower portion 86. The hosel liner has an external opening 93 and an internal opening 95. The lower portion 86 is positioned within the chamber 77 of the removable insert 51. The diameter A of the chamber 77 should securely accommodate the diameter of the lower portion 86. The upper portion 84 rests above the crown 24. The hosel liner 50 is preferably composed of a polymer material such as a polycarbonate material. The hosel liner 50 is designed to relieve stress that is placed on the shaft 40 during the impact between a golf club head 22 impact and a golf ball. The hosel liner 50 prevents substantial contact between the shaft 40, typically graphite, and the metal golf club head 22.

Figure 3:
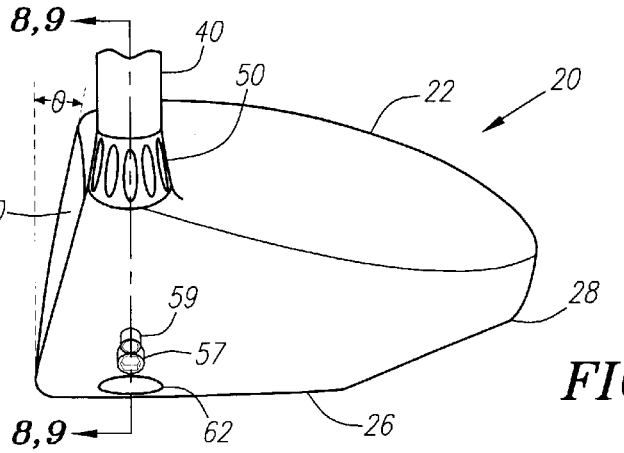
FIG. 3 is a heel end side view of the golf club fitting device of FIG. 1.
Figure 4:
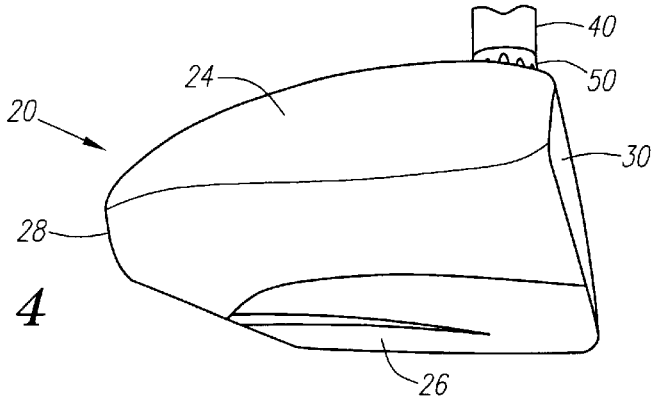
FIG. 4 is a toe end side view of the golf club fitting device of FIG. 1.
Figure 5:
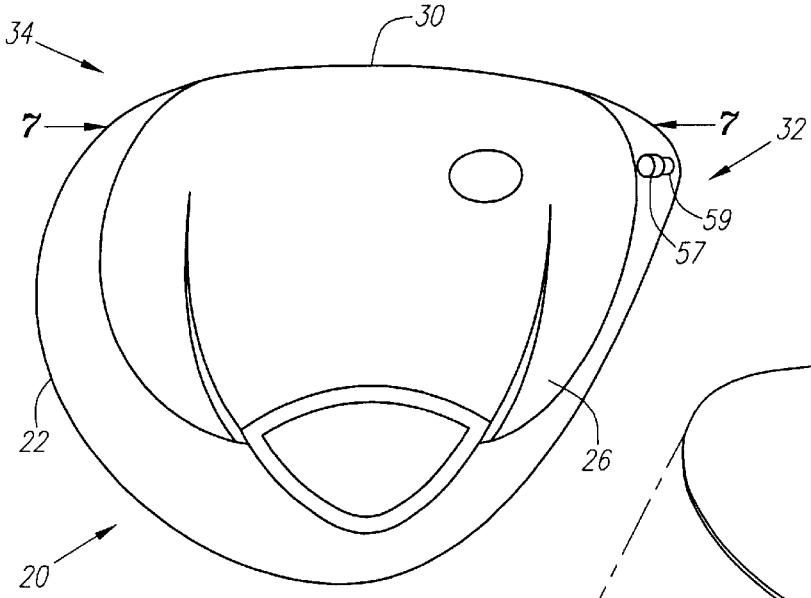
FIG. 5 is a bottom plan view of the golf club fitting device of FIG. 1.
Figure 6:
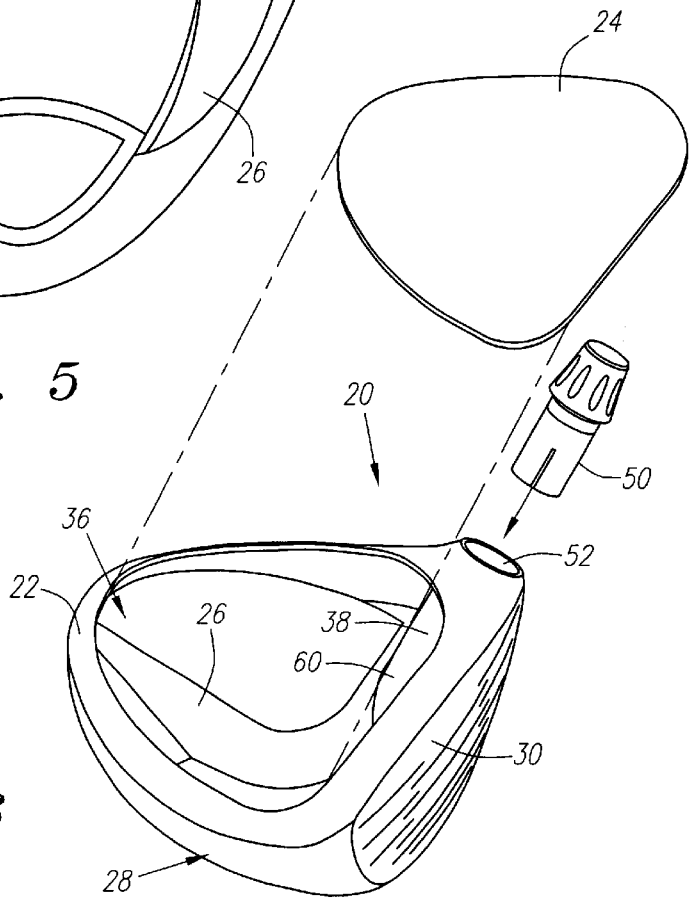
FIG. 6 is an exploded perspective view of the golf club fitting device of FIG. 1.
Figure 15:
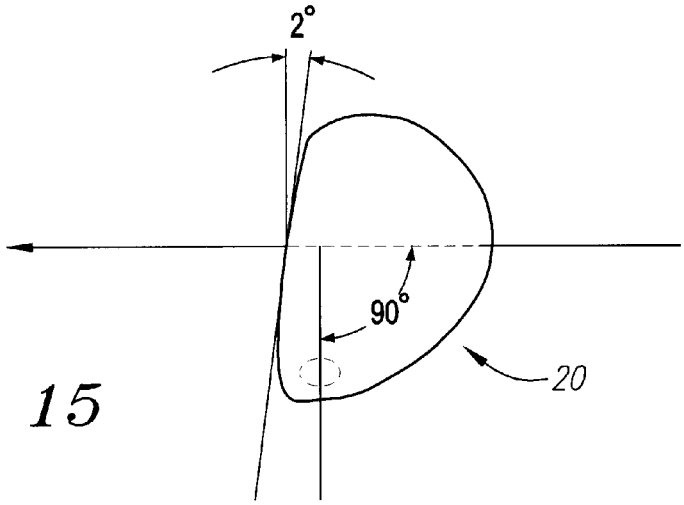
FIG. 15 is a top plan view of the golf club fitting device of the present invention with an open face angle.
Figure 16:
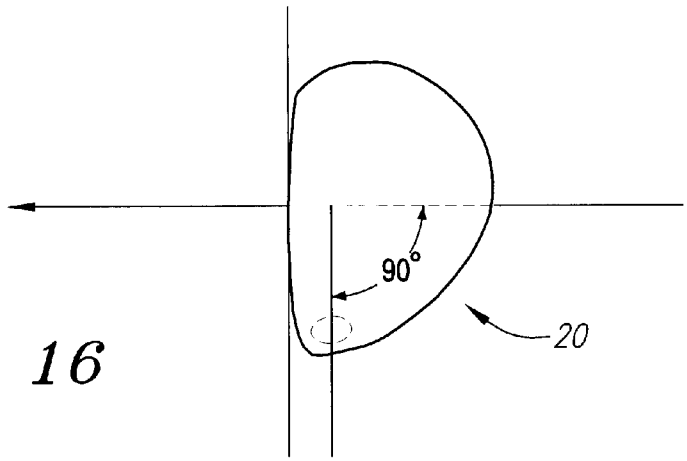
FIG. 16 is a top plan view of the golf club fitting device of the present invention with a square face angle.
Figure 17:
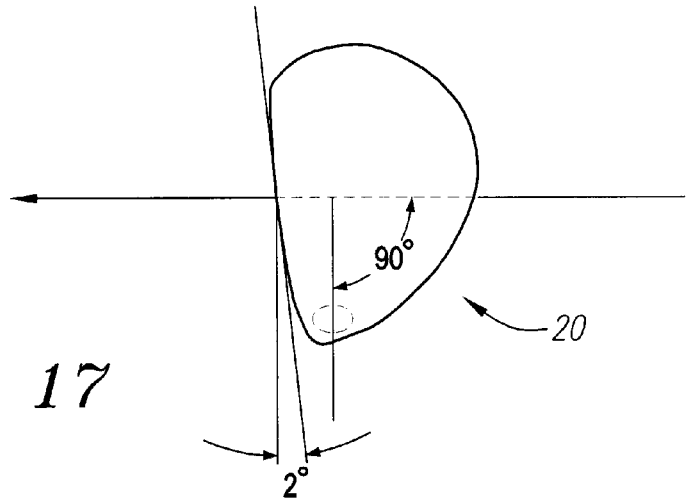
FIG. 17 is a top plan view of the golf club fitting device of the present invention with a closed face angle.

During a typical fitting using the golf club fitting device 20 of the present invention, a golfer begins with a standard shaft 40 attached to a standard golf club head 22. The golfer swings the golf club fitting device 20 to determine which parameters should be adjusted for the golfer. The removable insert 51 allows for the face angle of the golf club to be adjusted by pulling the locking member 57 outward and slightly rotating the removable insert 51. The tapered end 63 of the rotation detent 59 will then engage another of the plurality of recesses 83 for preventing rotation of the removable insert 51. Locking member 57 is engaged against the annular indentation 73 to prevent rotation or release of the removable insert 51 during a golf swing. FIGS. 15–17 illustrate the variation in the face angle of the golf club fitting device 20. In FIG. 15, the golf club fitting device 20 has a face angle of two degrees negative, an open face angle, indicative of a slice. If the loft angle of the golf club fitting device 20 is ten degrees, then the effective loft angle is eight degrees. The loft angle $\theta_L$ of the golf club fitting device 20 is shown in FIG. 3. In FIG. 16, the golf club fining device 20 has a face angle of zero degrees or a square face angle. If the loft angle of the golf club fining device 20 is ten degrees, then the effective loft angle is ten degrees since the face angle is square. In FIG. 17, the golf club fitting device 20 has a face angle of two degrees positive, a closed face angle, indicative of a hook. If the loft angle of the golf club fining device 20 is ten degrees, then the effective loft angle is twelve degrees. A more detailed explanation of loft angles, face angles and lie angles is provided in Maltby, *Golf Club Design, Fitting Alteration & Repair*; $4^{th}$ Edition, 1995, (primarily chapters 39–43) which relevant parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club fitting device comprising:

a golf club head having a crown, a sole, a striking plate, a heel end, a toe end and an internal hosel having a hosel wall defining a bore that extends from a crown opening to a sole opening at the sole, the heel end of the golf club head having a first aperture extending through the hosel wall and a second aperture extending through the hosel wall;

a removable insert disposed within the internal hosel, the removable insert having a cylindrical body with an annular indentation and a plurality of recesses, the cylindrical body defining a bore that is disposed at a predetermined angle within the cylindrical body to define a face angle of the golf club;

a first locking member for removable engagement with the annular indentation through the first aperture of the golf club head;

a second locking member for removable engagement with one of the plurality of recesses through the second aperture of the golf club head; and a shaft having a tip end and a butt end, the tip end shaft positioned through die bore of the removable insert.

2. The golf club fitting device according to claim 1 further comprising a hosel liner having an upper portion, a lower portion and a bore therethrough for positioning of the shaft therein, the upper portion having a greater diameter than the lower portion, the lower portion positioned within the bore of the removable insert, the hosel liner having a shoulder below the upper portion, the shoulder engaging the crown, and the hosel liner composed of a polymer material.

3. The golf club fitting device according to claim 2 wherein the hosel liner is fixedly secured within the bore of the removable insert, and the tip end of the shaft is fixedly secured within the bore of the hosel liner.

4. The golf club fitting device according to claim 1 wherein the golf club head is composed of a material selected from the group consisting of titanium, titanium alloys, stainless steel, amorphous metals, a composite material, magnesium, and a polymer material.

5. The golf club fitting device according to claim 1 wherein the cylindrical body of the removable insert has an upper portion and a lower portion, the annular indentation juxtaposed by the upper portion and the lower portion, the plurality of recesses disposed on the upper portion, the upper portion capable of rotation about a vertical axis through the center of the bore of the internal hosel to adjust the face angle of golf club head relative to the shaft.

6. The golf club fitting device according to claim 5 wherein the face angle may vary between plus or minus three degrees upon rotation of the upper portion of the removable insert.

7. The golf club fitting device according to claim 1 wherein the first locking member is a pin with an exterior portion and an interior portion, the exterior portion having a diameter greater than the diameter of the interior portion and greater than the diameter of the first aperture.

8. The golf club fitting device according to claim 1 wherein the second locking member is a pin with a tapered end for engagement with one of the plurality of recesses.

9. The golf club fining device according to claim 1 wherein the golf club head has a volume greater than 300 cubic centimeters.

10. A golf club fitting device comprising:

a golf club head having a crown, a sole, a striking plate, a heel end, a toe end and an internal hosel having a hosel wall defining a bore that extends from a crown opening to a sole opening at the sole, the heel end of the golf club head having a first aperture extending through the hosel wall and a second aperture extending through the hosel wall;

a removable insert disposed within the internal hosel, the removable insert having a cylindrical body with an annular indentation and a plurality of recesses, the cylindrical body defining a chamber that is disposed at a predetermined angle within the cylindrical body to define a face angle of the golf club;

a first locking member for removable engagement with the annular indentation through the first aperture of the golf club head;

a second locking member for removable engagement with one of the plurality of recesses through the second aperture of the golf club head; and a hosel liner having an upper portion, a lower portion and a bore therethrough, the upper portion having a greater diameter than the lower portion, the lower portion positioned within the chamber of the removable insert, die hosel liner having a shoulder below die upper portion, the shoulder engaging the crown, and the hosel liner composed of a polymer material; and, a shaft having a tip end and a butt end, the tip end of the shaft positioned within the bore of the hosel liner.

11. The golf club according to claim 10 wherein the golf club head is composed of a material selected from the group consisting of titanium, titanium alloys, stainless steel, amorphous metals, a composite material, magnesium, and a polymer material.

12. The golf club according to claim 10 wherein the upper portion of the removable insert is capable of rotation within the internal hosel such that a quarter rotation of the upper portion of the removable insert within the bore of the internal hosel will result in a modification of the face angle of the golf club of at least one-half degree.

13. The golf club according to claim 10 wherein the golf club head has a volume greater than 300 cubic centimeters.

14. The golf club according to claim 10 wherein the shaft is composed of a material selected from the group consisting of graphite, stainless steel, titanium, and any combination thereof.

* * * * *